US008979486B2

(12) United States Patent
Rioux

(10) Patent No.: US 8,979,486 B2
(45) Date of Patent: Mar. 17, 2015

(54) INTERSEGMENT SPRING "T" SEAL

(75) Inventor: Philip Robert Rioux, North Berwick, ME (US)

(73) Assignee: United Technologies Corporation, Hartford, CT (US)

( * ) Notice: Subject to any disclaimer, the term of this patent is extended or adjusted under 35 U.S.C. 154(b) by 593 days.

(21) Appl. No.: 13/347,663

(22) Filed: Jan. 10, 2012

(65) Prior Publication Data

US 2013/0177387 A1 Jul. 11, 2013

(51) Int. Cl.
*F01D 9/04* (2006.01)
*F01D 11/00* (2006.01)

(52) U.S. Cl.
CPC ..... *F01D 11/005* (2013.01); *F05D 2240/11* (2013.01); *F05D 2240/57* (2013.01)
USPC ..... 415/191; 415/211.2; 415/1; 277/631; 277/637

(58) Field of Classification Search
CPC ..... F01D 11/005
USPC ..... 415/173.1, 139, 1, 191, 211.2; 277/631, 277/637, 647, 649
See application file for complete search history.

(56) References Cited

U.S. PATENT DOCUMENTS

| | | | | |
|---|---|---|---|---|
| 4,385,864 | A | 5/1983 | Zacherl | |
| 4,897,021 | A | 1/1990 | Chaplin et al. | |
| 5,462,403 | A | 10/1995 | Pannone | |
| 5,868,398 | A * | 2/1999 | Maier et al. | 277/643 |
| 5,988,975 | A | 11/1999 | Pizzi | |
| 6,139,264 | A | 10/2000 | Schilling | |
| 6,193,240 | B1 * | 2/2001 | Johnson et al. | 277/643 |
| 6,431,825 | B1 * | 8/2002 | McLean | 415/135 |
| 6,893,215 | B2 | 5/2005 | Kuwabara et al. | |
| 7,101,147 | B2 * | 9/2006 | Balsdon | 415/135 |
| 7,600,967 | B2 | 10/2009 | Pezzetti, Jr. et al. | |
| 7,901,186 | B2 * | 3/2011 | Cornett et al. | 416/198 A |
| 2005/0082768 | A1 | 4/2005 | Iguchi | |

FOREIGN PATENT DOCUMENTS

| | | |
|---|---|---|
| EP | 2055900 | 5/2009 |
| EP | 2395201 | 12/2011 |

OTHER PUBLICATIONS

European Search Report for European Patent Application No. 13150877.2-1610 completed on Mar. 13, 2013.

* cited by examiner

*Primary Examiner* — Ninh H Nguyen
(74) *Attorney, Agent, or Firm* — Carlson, Gaskey & Olds, P.C.

(57) ABSTRACT

A spring seal includes a split body portion with a first leg and a second leg that extend away from a plane and a projection portion which extends from the split body portion within the plane.

17 Claims, 5 Drawing Sheets

INTERSEGMENT SPRING "T" SEAL

BACKGROUND

The present disclosure relates to gas turbine engines, and in particular, to an intersegment seal assembly therefor.

Feather seals are commonly utilized in aerospace and other industries to provide a seal between two adjacent components. For example, gas turbine engine vanes are arranged in a circumferential configuration to form an annular vane ring structure about an engine axis. Typically, each stator segment includes an airfoil and a platform section. When assembled, the platforms abut and define a radially inner and radially outer boundary to a core airflow path.

Typically, the edge of each platform includes a channel which receives a feather seal assembly that seals the hot gas core airflow from a surrounding medium such as a cooling airflow. Radial leakage through intersegment gaps within the high compressor may lead to loss in efficiency and stability. With the introduction of smaller clusters and singlets, the number of intersegment gaps and leakage potential therefrom has increased.

SUMMARY

A spring seal assembly according to an exemplary aspect of the present disclosure includes a split body portion with a first leg and a second leg that extend away from a plane. A projection portion which extends from the split body portion within the plane.

In a further non-limiting embodiment of any of the foregoing spring seal assembly embodiments, the first leg and the second leg may define a "V" shape.

In a further non-limiting embodiment of any of the foregoing spring seal assembly embodiments, the projection portion may be twice the thickness of the first leg and the second leg.

In a further non-limiting embodiment of any of the foregoing spring seal assembly embodiments, the split body may be formed by a first member and a second member joined along the plane.

In a further non-limiting embodiment of any of the foregoing spring seal assembly embodiments, the first member and the second member may be formed of a steel alloy.

In a further non-limiting embodiment of any of the foregoing spring seal assembly embodiments, the end sections of the first leg and the second leg may be curved toward the plane.

A compressor section of a gas turbine engine according to another exemplary aspect of the present disclosure includes a multiple of arcuate vane support segments defined about an engine axis, and a spring seal between each pair of the multiple of arcuate vane support segments.

In a further non-limiting embodiment of any of the foregoing compressor section embodiments, the spring seal may define a first leg and a second leg that extend away from a plane which contains the engine axis.

In a further non-limiting embodiment of any of the foregoing compressor section embodiments, the first leg and the second leg may define a "V" shape.

In a further non-limiting embodiment of any of the foregoing compressor section embodiments, the spring seal may define a projection portion and the multiple of arcuate vane support segments may define a projection. The projection portion and the projection may fit within an annular slot around the engine axis.

In a further non-limiting embodiment of any of the foregoing compressor section embodiments, the slot may be formed between a full ring case section and an air seal.

A method of sealing a compressor section of a gas turbine engine according to an exemplary aspect of the present disclosure includes compressing a spring seal between each pair of a multiple of arcuate vane support segments about an engine axis.

In a further non-limiting embodiment of any of the foregoing methods, the method may include circumferentially mounting the multiple of arcuate vane support segments.

In a further non-limiting embodiment of any of the foregoing methods, the method may include mounting the spring seal in the same manner as the multiple of arcuate vane support segments.

In a further non-limiting embodiment of any of the foregoing methods, the method may include mounting the spring seal and the multiple of arcuate vane support segments in a common annular slot.

In a further non-limiting embodiment of any of the foregoing methods, the method may include mounting the spring seal and the multiple of arcuate vane support segments in two opposed annular slots.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
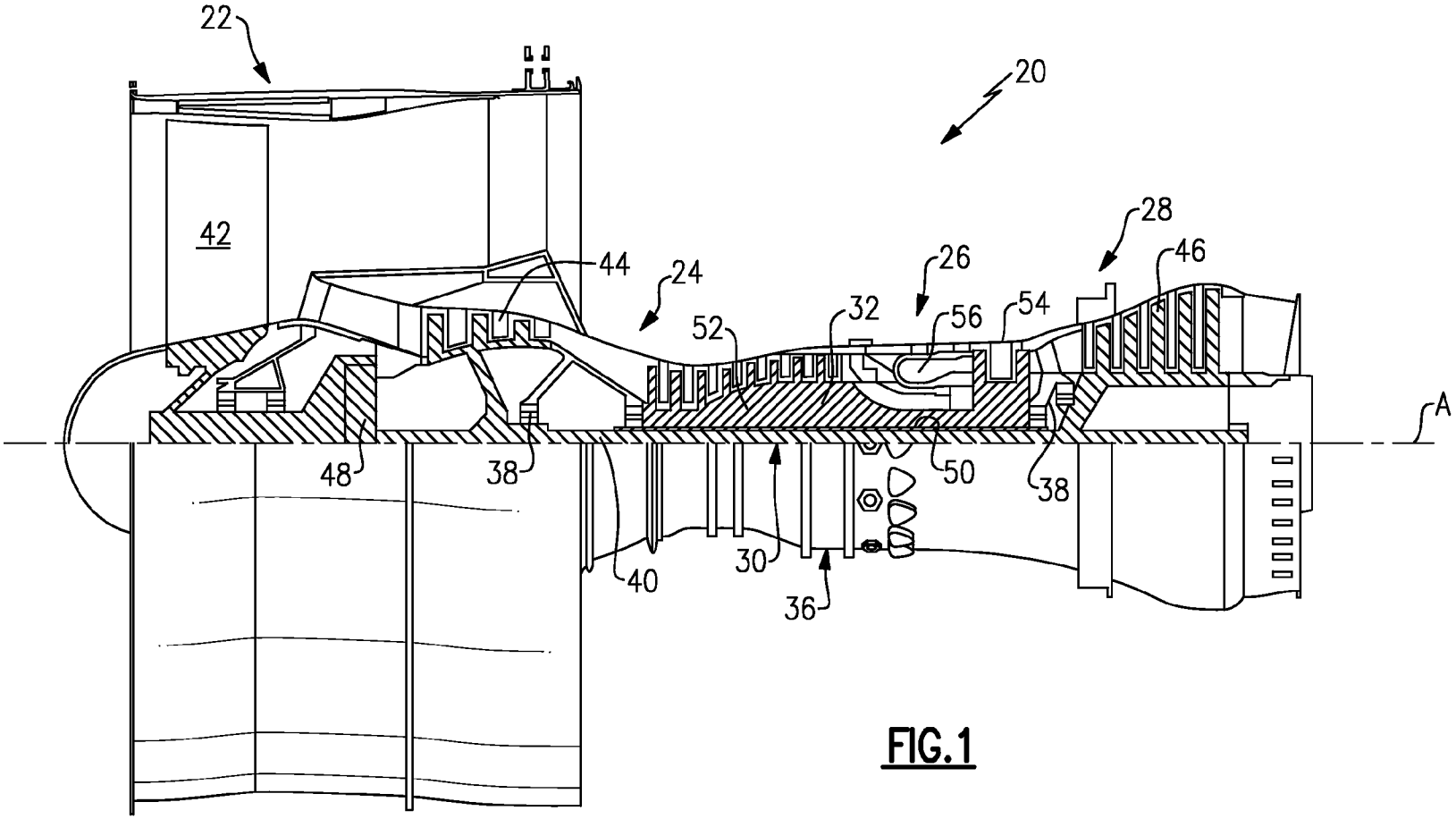
FIG. 1 is a schematic cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
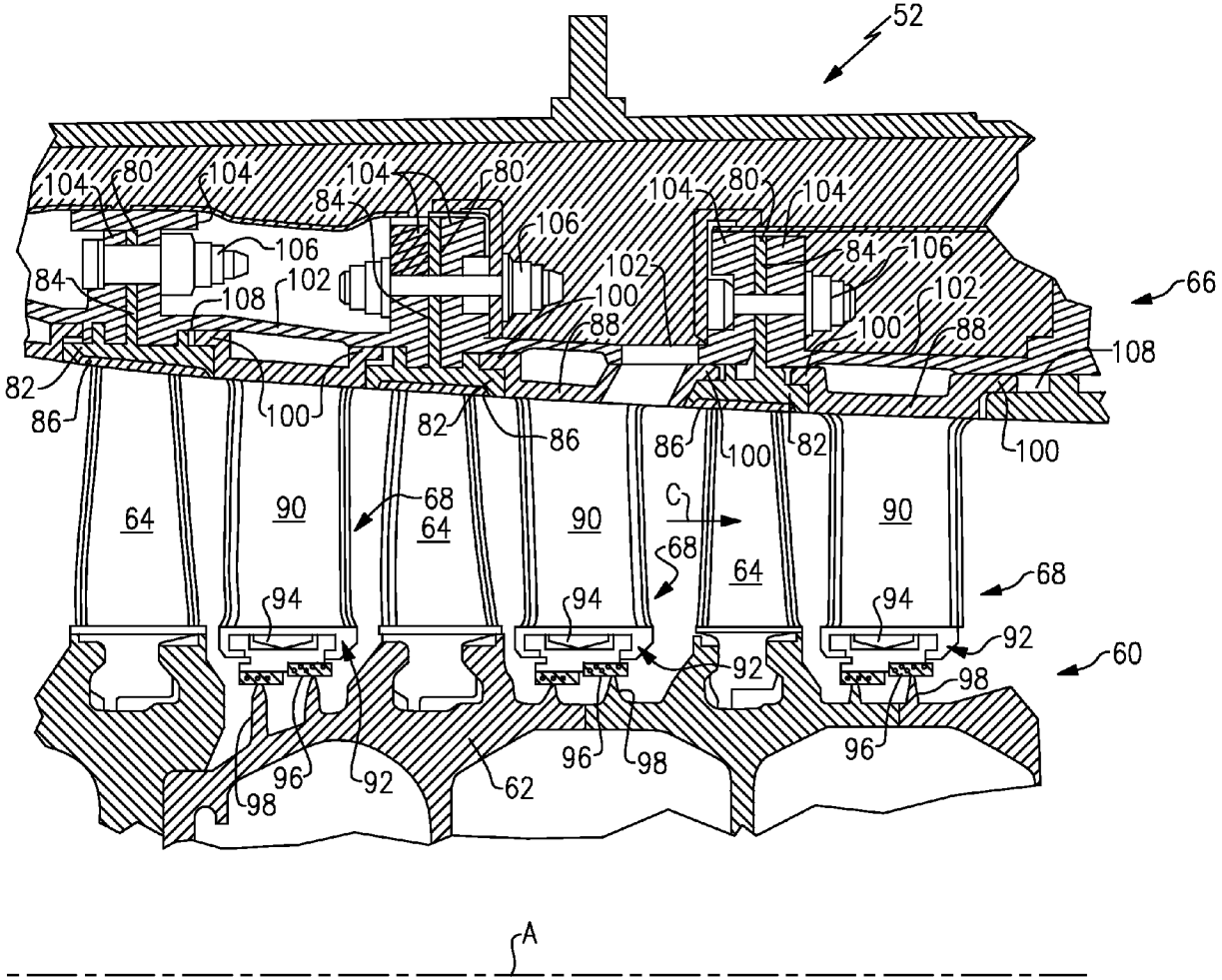
FIG. 2 is an expanded view of a compressor section of the gas turbine engine.

With reference to FIG. 2, the high pressure compressor 52 generally includes a rotor assembly 60 with a drum rotor 62 that supports arrays of rotor blades 64 which extend outward across the core airflow path C and a stator assembly 66 that extends circumferentially about the rotor assembly 60 and extends axially to bound the core airflow path C. The stator assembly 66 generally includes arrays of stator vane assemblies 68 disposed between the arrays of rotor blades 64. Each array of stator vane assemblies 68 extends inward across the core airflow path C. It should be appreciated that although a section of the HPC is disclosed herein in the illustrated non-limiting embodiment, other sections of the engine will benefit herefrom.

The stator assembly 66 includes outer air seals 80 which, in the disclosed non-limiting embodiment, are of a "T" cross-section. The outer air seals 80 may be full rings or arcuate segments. The base 82 of the "T" extends radially outwardly while a head 84 of each "T" extends substantially parallel to the core airflow path. An abradable seal 86 may be secured within the outer air seal 80 to bound each array of rotor blades 64.

The outer air seals 80 at least partially support a multiple of arcuate vane support segments 88. Each arcuate vane support segment 88 may include one or more stator vane airfoils 90 (also shown in FIG. 3). The stator vane airfoils 90 extend inwardly from the vane support segment 88 and terminate in an inner shroud 92. The inner shroud 92 may support a damper 94 with an abradable air seal 96 which interface with knife edges 98 on the drum rotor 62 to provide an airflow seal.

Each arcuate vane support segment 88 include axial projections 100 which fit against an outer surface of the air seal 80 and are entrapped against an inner surface of a full ring case section 102. Each full ring case section 102 includes flanges 104 to interface with the base 82 of a respective air seal 80 and is attached thereto with a fastener 106. An annular slot 108 defined about the engine axis A is thereby formed between the full ring case section 102 and the air seal 80 into which the projections 100 are received. The multiple of arcuate vane support segments 88 are axially and radially supported to be circumferentially arranged and collectively form the full, annular ring of stator vane airfoils 90 about the axis A.

Figure 3:
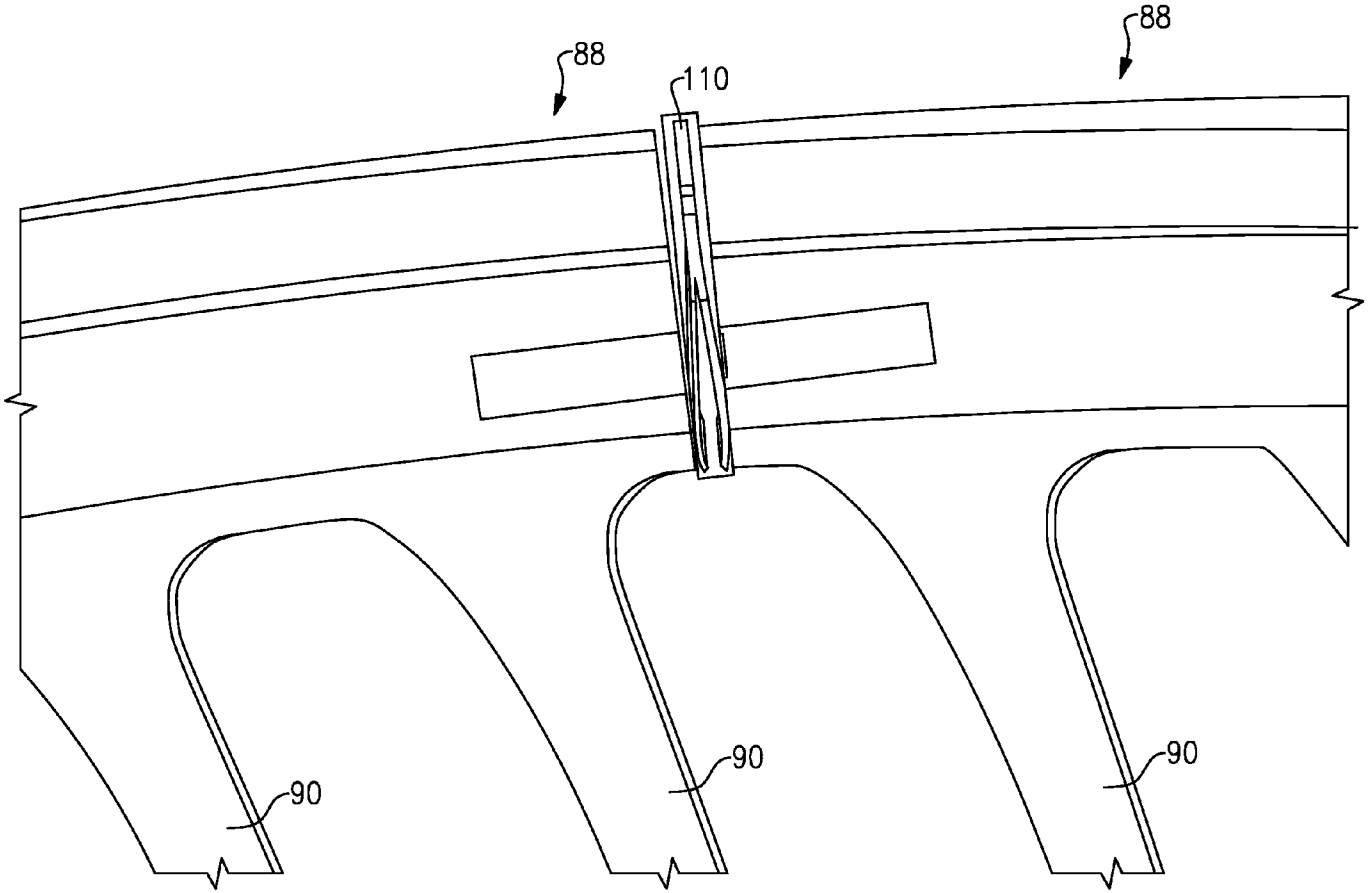
FIG. 3 is an frontal view of a spring seal mounted between two representative segments.

With reference to FIG. 3, a spring seal 110 is located between each pair of arcuate vane support segments 88. The spring seal 110 is shaped generally the same as the cross-section of the arcuate vane support segments 88. That is, the spring seal 110 fits within the annular slot 108 (FIG. 2).

Figure 4:
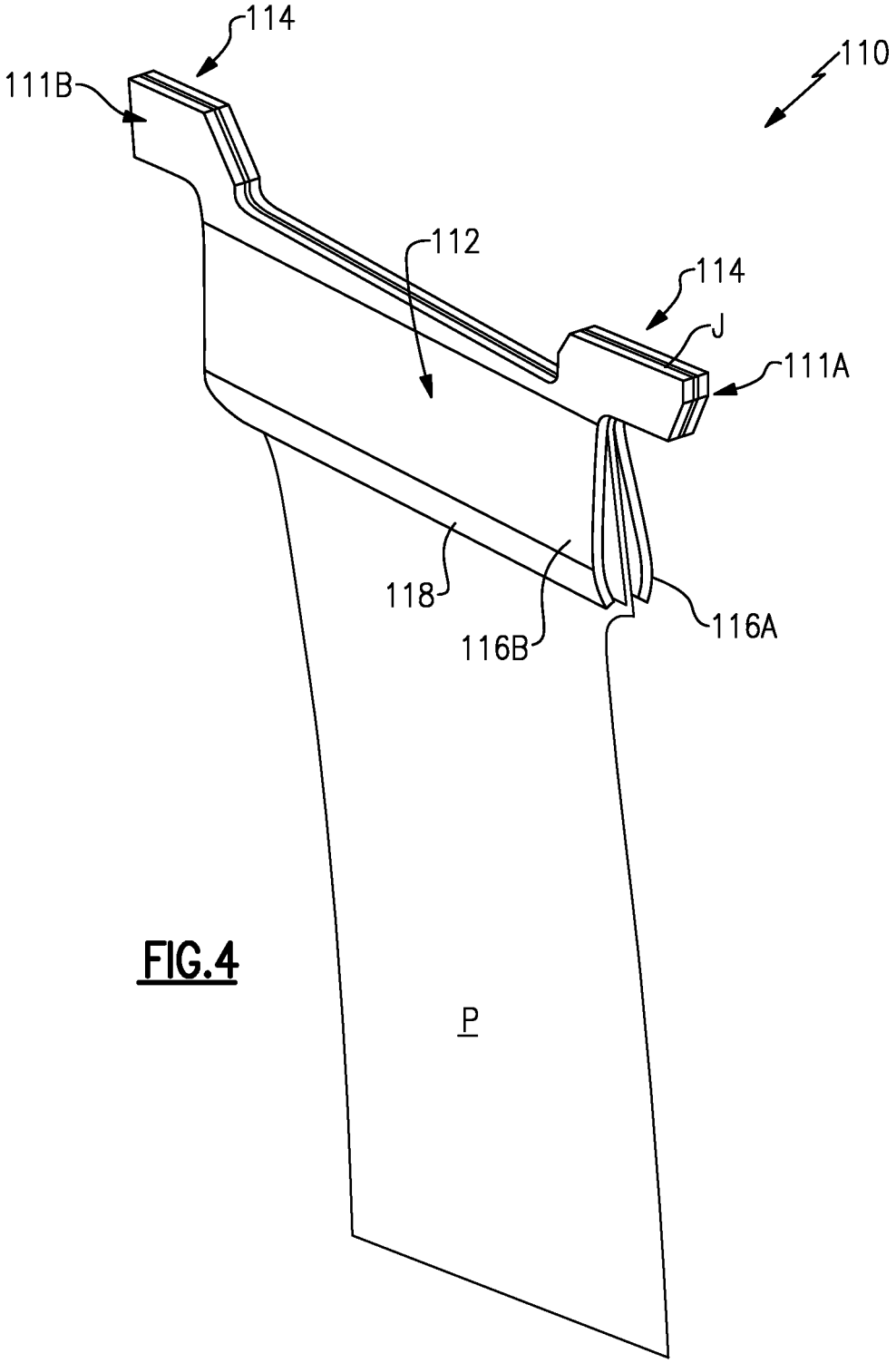
FIG. 4 is a perspective view of a spring seal.

With reference to FIG. 4, the spring seal 110 may be manufactured of two members 111A, 111B such as a steel alloy sheet which are welded, brazed or otherwise attached together to form a split body portion 112 and a projection portion 114 which extend from the split body portion 112. The split body portion 112 is defined by a first leg 116A and a second leg 116B which define a generally "V" shape in cross section. That is, the first leg 116A and the second leg 116B extend away from a central plane P which contains the joint J between the two members 111A, 111B. Curved edges 118 may be further provided which extend at least somewhat toward the plane P.

Figure 5:
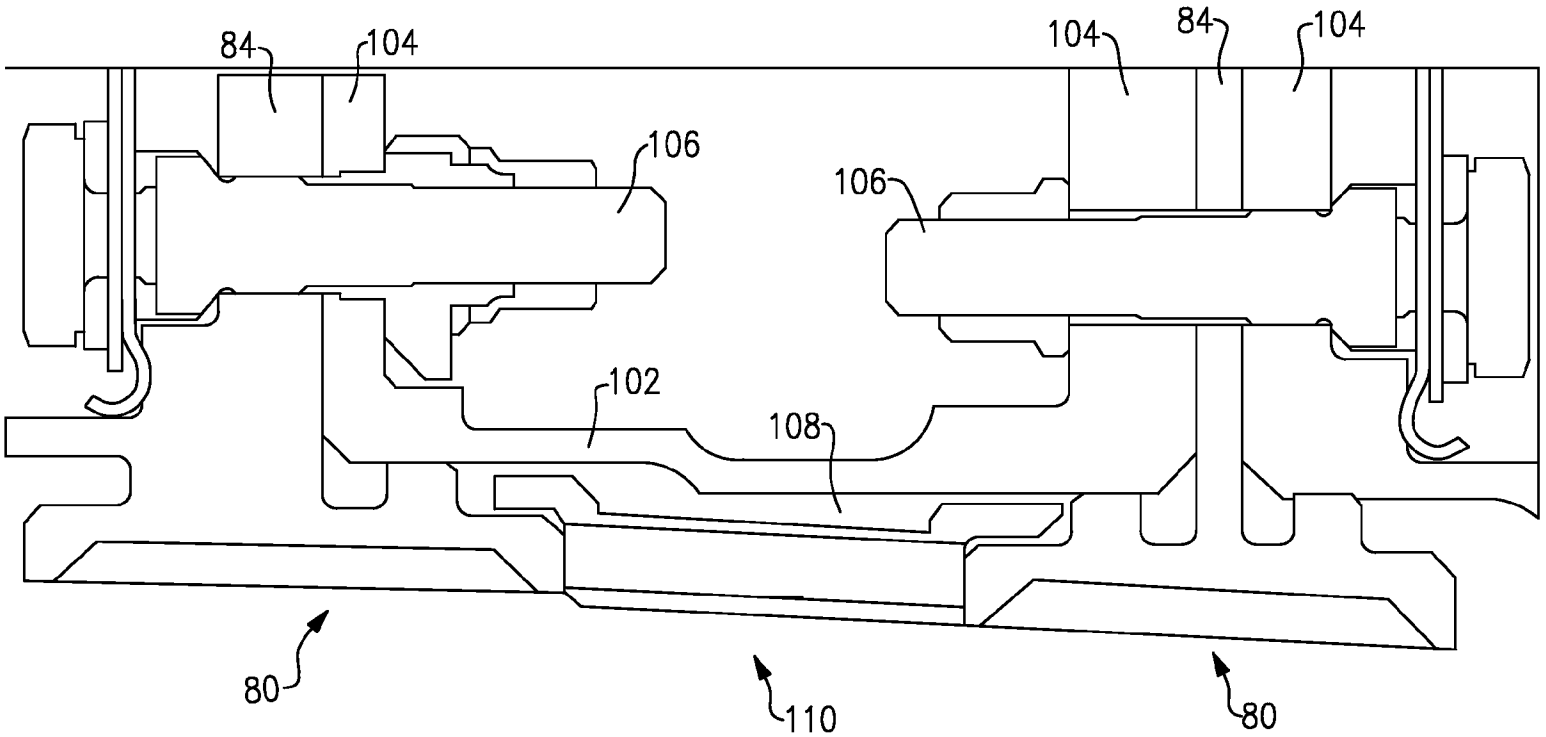
FIG. 5 is an expanded axial sectional view of a mounted spring seal.

The projection portion 114 is formed by both members 111A, 111B and extends from the first leg 116A and the second leg 116B within the plane P. That is, the projection portion 114 are twice the thickness of the first leg 116A and the second leg 116B as the projections are formed by both members 111A, 111B while the first leg 116A and the second leg 116B are each formed by one member 111A, 11B. The projection portion 114 allows the spring seal 110 to be mounted in the same manner as the arcuate vane support segments 88 to which they abut (FIG. 5).

On assembly the loaded spring seal 110 is compressed by the adjacent arcuate vane support segments 88 to yield a tight intersegment gap between the adjacent arcuate vane support segments 88 and damping thereof. Pressure from within the core airflow path further loads the spring seal 110 and tends to open the first leg 116A and the second leg 116B to further facilitate the seal. This results in an increased surge margin attributed to the more effective seal.

The radial gap could be reduced up to thirty times as compared to some standard configurations. For stator singlets, the radial gap may be reduced approximately eight times for all 140 or so intersegment interfaces which results in significant leakage reductions as compared to conventional feather seals. Also, unlike feather seals, the spring seals 110 require no machining of the stators and may reduce the weight of stators as no feather seal bosses are required.

The spring seals 110 may also be utilized with singlets where feather seals may not be possible. As the spring seals 110 also slide into the case there would be much less FOD risk than feather seals. Furthermore, for small clusters and singlets the spring seals 110 prevent excessive circumferential stacking against anti-rotation features that result in several large gaps around the stage which may reduce stability.

It should be understood that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A compressor section of a gas turbine engine comprising:

a multiple of arcuate vane support segments defined about an engine axis; and a spring seal between each pair of said multiple of arcuate vane support segments, wherein said spring seal defines a first leg and a second leg that extend away from a plane which contains said engine axis.

2. The compressor section as recited in claim 1, wherein said first leg and said second leg define a "V" shape.

3. A compressor section of a gas turbine engine comprising:

a multiple of arcuate vane support segments defined about an engine axis; and a spring seal between each pair of said multiple of arcuate vane support segments, wherein said spring seal defines a projection portion and said multiple of arcuate vane support segments define a projection, said projection portion and said projection fit within an annular slot around said engine axis.

4. The spring seal as recited in claim 3, wherein said slot is formed between a full ring case section and an air seal.

5. A method of sealing a compressor section of a gas turbine engine comprising:

compressing a spring seal between each pair of a multiple of arcuate vane support segments about an engine axis, wherein said spring seal defines a first leg and a second leg that extend away from a plane which contains said engine axis.

6. The method as recited in claim 5, further comprising:

circumferentially mounting the multiple of arcuate vane support segments.

7. The method as recited in claim 5, further comprising:

mounting the spring seal in the same manner as the multiple of arcuate vane support segments.

8. The method as recited in claim 5, further comprising:

mounting the spring seal and the multiple of arcuate vane support segments in a common annular slot.

9. The method as recited in claim 5, further comprising:

mounting the spring seal and the multiple of arcuate vane support segments in two opposed annular slots.

10. A spring seal for a gas turbine engine comprising:

first and second seal members including, a projection portion at which said first and second seal members are united together, said projection portion extending along a plane containing the longitudinal axis of the gas turbine engine and including first and second tabs, and a split body portion in which said first and second seal members split into first and second legs extending away from said plane, wherein said first and second tabs project, respectively, within said plane beyond lateral edges of said first and second legs.

11. The spring seal as recited in claim 10, wherein said first leg and said second leg define a "V" shape.

12. The spring seal as recited in claim 10, wherein said projection portion is twice the thickness of said first leg and said second leg.

13. The spring seal as recited in claim 10, wherein said first seal member and said second seal member are formed of a steel alloy.

14. The spring seal as recited in claim 10, wherein end sections of said first leg and said second leg are curved toward said plane.

15. The spring seal as recited in claim 10, wherein said first and second seal members are metallurgically bonded at said projection portion.

16. The spring seal as recited in claim 10, wherein said first and second legs are on opposed sides of said plane.

17. The spring seal as recited in claim 16, wherein said first and second legs arc toward each other and toward said plane.

* * * * *